US008246260B2

(12) United States Patent
Zhao et al.

(10) Patent No.: US 8,246,260 B2
(45) Date of Patent: Aug. 21, 2012

(54) PRINTER WITH RIBBON CASSETTE SHIFTING MECHANISM AND CONTROL METHOD THEREFOR

(75) Inventors: Zhenxing Zhao, Weihai (CN); Lei Zheng, Weihai (CN); Lei Che, Weihai (CN); Zhuanlong Yu, Weihai (CN)

(73) Assignee: Shandong New Beiyang Information Technology Co., Ltd., Weihai, Shandong Province (CN)

( * ) Notice: Subject to any disclaimer, the term of this patent is extended or adjusted under 35 U.S.C. 154(b) by 553 days.

(21) Appl. No.: 12/523,476

(22) PCT Filed: Jan. 17, 2008

(86) PCT No.: PCT/CN2008/070121

§ 371 (c)(1),
(2), (4) Date: Jul. 16, 2009

(87) PCT Pub. No.: WO2008/089682

PCT Pub. Date: Jul. 31, 2008

(65) Prior Publication Data

US 2010/0221053 A1 Sep. 2, 2010

(30) Foreign Application Priority Data

Jan. 17, 2007 (CN) ..... 2007 1 0002431

(51) Int. Cl.
*B41J 35/18* (2006.01)

(52) U.S. Cl. ..... 400/212; 400/211

(58) Field of Classification Search ..... 400/211, 400/212, 697, 697.1; *B41J 35/18; B41K 35/14*
See application file for complete search history.

(56) References Cited

U.S. PATENT DOCUMENTS

| | | | | |
|---|---|---|---|---|
| 5,064,304 | A | 11/1991 | Hosokawa et al. | |
| 5,360,279 | A | 11/1994 | Asai et al. | |
| 5,468,078 | A | 11/1995 | Asai et al. | |
| 6,431,774 | B1 * | 8/2002 | Matsumoto | 400/225 |

FOREIGN PATENT DOCUMENTS

| | | |
|---|---|---|
| CN | 1264649 | 8/2000 |
| EP | 0552486 | 7/1993 |

(Continued)

OTHER PUBLICATIONS

JP2009-545805, Jul. 12, 2011, Japanese Office Action.

*Primary Examiner* — Daniel J Colilla
(74) *Attorney, Agent, or Firm* — Workman Nydegger

(57) ABSTRACT

A printer includes a print head moving in printing and shifting regions, a carriage connecting the print head and the print head transport mechanism, and a ribbon cassette mounting mechanism that drives a multicolor ribbon cassette to swing. A ribbon cassette supporting mechanism in the shifting region correspondingly supports the ribbon cassette mounting mechanism to different levels to shift color of the ink ribbon while the ribbon cassette supporting mechanism rotates. A ribbon cassette shifting mechanism fixed on the carriage is used, in the shifting region, to lift the ribbon cassette mounting mechanism to a position disengaged from the ribbon cassette supporting mechanism and move the ribbon cassette supporting mechanism to rotate. A resetting mechanism fixed on the ribbon cassette supporting mechanism resets the ribbon cassette supporting mechanism when the ribbon cassette supporting mechanism no longer contacts the ribbon cassette mounting mechanism and the ribbon cassette shifting mechanism.

13 Claims, 8 Drawing Sheets

FOREIGN PATENT DOCUMENTS

| | | | | |
|---|---|---|---|---|
| EP | 08700778 | | | 11/2011 |
| JP | 61083075 | | | 4/1986 |
| JP | 02249681 | A | * | 10/1990 |
| JP | 04344282 | A | * | 11/1992 |
| JP | 5085026 | | | 4/1993 |
| JP | 05-162427 | | | 6/1993 |
| JP | 5318893 | | | 12/1993 |
| JP | 06-286279 | | | 10/1994 |

* cited by examiner

PRINTER WITH RIBBON CASSETTE SHIFTING MECHANISM AND CONTROL METHOD THEREFOR

CROSS REFERENCE TO RELATED APPLICATION

This application claims the benefit of Chinese Patent Application No. 200710002431.1, entitled "PRINTER AND PRINTING CONTROL METHOD" filed on Jan. 17, 2007 with the State Intellectual Property Office of PRC, which is hereby incorporated by reference in its entirety.

FIELD OF THE INVENTION

The present invention relates to a dot matrix printer capable of ink ribbon shifting and a printing control method.

BACKGROUND

At present, an ink ribbon used by a dot matrix printer generally consists of a ribbon cassette and a ribbon winding inside the ribbon cassette. Generally, two colors, i.e., black and red are provided side by side in the direction of the width of the ribbon. Through adapting the different-colored ribbon to a position opposite to a print head by swing the ribbon cassette and then forming color image or text by hitting ink on the ribbon of the ink ribbon onto a print medium with print needles on the print head, a color printing is implemented.

At present, a printer is disclosed in a Chinese Patent entitled "A PRINTER" (Application No. 00102697.6), which includes a main body having an ink ribbon cassette and an ink ribbon cassette lifting/lowering mechanism, with the latter detachably mounted on a side portion of a machine frame. The ink ribbon cassette lifting/lowering mechanism includes a gear mechanism for transmitting rotation of a driving shaft mounted on the frame to a bracket detachably mounted on the frame, a cam mechanism for lifting and lowering the ink ribbon cassette, a clutch for selectively transmitting rotation of the gear mechanism to the cam mechanism, and a actuator for connecting and disconnecting the clutch. Therefore, a monochrome printer is possibly to be used as a multi color printer and the rotating speed of the cam can be set freely. Although in this solution a monochrome printer can be used as a multi color printer, there are some drawbacks, i.e., when a monochrome printer is used as a multi color printer the structure of the ink ribbon cassette lifting/lowering mechanism will be complicated due to the need to provide the cam mechanism, the clutch and the actuator, resulting in higher costs for producing and controlling.

In addition, a technical solution disclosed in a US patent entitled "INK RIBBON SHIFTING PRINTER" (Publication No. U.S. Pat. No. 5,468,078) includes that the movement region of the print head is divided into three regions, i.e., one printing region and two non-printing regions, wherein, the two non-printing regions are respectively located at two ends of the printing region, an ink ribbon raising device and an ink ribbon releasing device are disposed respectively at the end-points of the two non-printing regions, in which the ink ribbon raising device is used for adjusting the relative position of the print head and the color of the ink ribbon such that the ink ribbon is disposed in a desirable color for printing, while the ink ribbon releasing device is used for releasing the ink ribbon to an original height.

This method involves too many regions (three regions), and meanwhile, each time an ink ribbon shifting takes place, the print head needs to pass through the whole region, i.e., the print head needs to move to a first non-printing region at an end in a movement direction for ink ribbon shifting, if it is to be reset, the print head needs to move to a second non-printing region at the other end for ink ribbon releasing. In this way, the print head needs to move too long a track to complete a set of shifting and releasing. At the same time, two devices, i.e., an ink ribbon raising device and an ink ribbon releasing device, need to be provided to perform the shifting and resetting of the ink ribbon in the prior art respectively. The printer provided by this prior art involves too many devices, and its structure is relatively complicated, so that it is much difficult to develop such prior art and the costs of electrics and controlling are too high.

SUMMARY OF THE INVENTION

In view of this, the object of the present invention is to provide an ink ribbon-shiftable printer of simple design and having relatively low costs for producing and controlling, as well as a printing control method.

To solve the problems described above, the present invention provides a printer, which comprises a print head, a print head transport mechanism capable of driving the print head to move reciprocally, a carriage connecting the print head and the print head transport mechanism, and a ribbon cassette mounting mechanism provided with a ribbon cassette for a multi color ink ribbon and capable of driving the ribbon cassette to swing, a movement region of the print head consists of one printing region and one shifting region, the printer further comprises a ribbon cassette supporting mechanism, a ribbon cassette shifting mechanism, and a resetting mechanism, wherein, the ribbon cassette supporting mechanism is located in the shifting region for correspondingly supporting the ribbon cassette mounting mechanism to different levels to shift color of the ink ribbon while the ribbon cassette supporting mechanism rotates to different angles;

the ribbon cassette shifting mechanism is fixed on the carriage and is used, in the shifting region, to lift the ribbon cassette mounting mechanism up to a position disengaged from the ribbon cassette supporting mechanism and move the ribbon cassette supporting mechanism to rotate to different angles; and the resetting mechanism is fixed on the ribbon cassette supporting mechanism for resetting the ribbon cassette supporting mechanism when the ribbon cassette supporting mechanism is no longer contacted with the ribbon cassette mounting mechanism and the ribbon cassette shifting mechanism.

Preferably, the ribbon cassette mounting mechanism comprises a ribbon cassette supporting plate for supporting the ribbon cassette, a supporting plate collision surface is provided on the ribbon cassette supporting plate;

the ribbon cassette shifting mechanism comprises a cam, on which a first collision surface opposite to the said collision surface of the supporting plate is provided, upon contact of the above two collision surfaces, the ribbon cassette supporting plate is lifted to a position disengaged from the ribbon cassette supporting mechanism as the cam moves forward.

Preferably, the ribbon cassette supporting plate is further provided with a shifting opening, after the cam holds the ribbon cassette supporting plate to the position disengaged from the ribbon cassette supporting mechanism, as continually moving forward, the cam moves into the shifting opening and in the shifting opening implements the shifting by continually moving forward and thus moving the ribbon cassette supporting mechanism to rotate.

Preferably, the ribbon cassette supporting plate is further provided with a slot, such that the ribbon cassette supporting mechanism is snapped into the slot after rotating to a set angle, so as to restrain the ribbon cassette supporting mechanism at the set angle.

Preferably, the ribbon cassette supporting mechanism comprises a swing block and a swing block rotating shaft, with the swing block being swingable horizontally around the swing block rotating shaft;

The swing block is further provided with steps for cooperating with the slot, enabling a corresponding step to snap into the slot when the swing block rotates to a set angle and correspondingly, the ribbon cassette supporting plate is supported at a position where the required color is opposite to the print head.

Preferably, the resetting mechanism comprises a resetting elastic element for resetting the ribbon cassette supporting mechanism to an original position.

Preferably, the ribbon cassette shifting mechanism further comprises:

a rotating shaft and a carriage rotating shaft groove, the cam is installed in the carriage rotating shaft groove through the rotating shaft, so that the cam can rotate freely in a vertical plane along with the rotating shaft; and a cam elastic element fixed between the cam and the carriage, the cam is reset to an original position by the cam elastic element.

Preferably, the ribbon cassette supporting mechanism further comprises a bracket supported under the ribbon cassette mounting mechanism, a bracket supporting edge is further provided at an end of the bracket to lap with the bottom surface of the ribbon cassette supporting plate when the ribbon cassette is located an original position.

Preferably, the printer further comprises a ribbon cassette supporting plate elastic element fixed between the bracket and the ribbon cassette supporting plate.

Preferably, the printer further comprises a controller that controls movement of the print head according to a step number of the movement of the print head corresponding to a color to be shifted into.

Based on the technical solution described above, the present invention also provides a printing control method, a print head of a printer is moved in a movement region consisting of one printing region and one shifting region, when shifting the print color, the print head drives a ribbon cassette shifting mechanism to move from the printing region to the shifting region, so as to contact a ribbon cassette mounting mechanism; and after the ribbon cassette mounting mechanism is lifted up to a position disengaged from a ribbon cassette supporting mechanism of the print, the ribbon cassette shifting mechanism continues to move forward, contact the ribbon cassette supporting mechanism and pushes the ribbon cassette supporting mechanism to rotate to different angles, so as to correspondingly make the ribbon cassette supporting mechanism support the ribbon cassette mounting mechanism at different levels, or after lifting the ribbon cassette mounting mechanism up to a position disengaged from the ribbon cassette supporting mechanism, the ribbon cassette shifting mechanism is no longer contacted with the ribbon cassette supporting mechanism, so as to allow the ribbon cassette supporting mechanism to reset to an original angle.

Preferably, when the ribbon cassette supporting mechanism rotates to the original angle, correspondingly, the ribbon cassette mounting mechanism is supported at an original position;

the step at which the ribbon cassette shifting mechanism pushes the ribbon cassette supporting mechanism to rotate to different angles specifically is:

the print head continues to move forward by a set step number, and drives the ribbon cassette shifting mechanism, which in turn pushes the ribbon cassette supporting mechanism to rotate to a set angle; and the step at which the ribbon cassette shifting mechanism is no longer contacted with the ribbon cassette supporting mechanism specifically is:

the print head drives the ribbon cassette shifting mechanism to move from the shifting region to the printing region.

Preferably, the method further comprises: it is determined whether a step number of the print head corresponding to a new color equals to the step number of the print head corresponding to the current color, if yes, printing is performed directly; otherwise, a shifting action is performed.

Comparing with the prior art, the present invention has the following advantages:

In the present invention, the movement region in which the print head can move only has two regions, i.e., one printing region and one shifting region. Besides, in the present invention, the shifting mechanism and the resetting mechanism are integrated together, so that the structure is simple and is convenient to operate and maintain. Also, in the present invention, it is possible to implement shifting or resetting of the ink ribbon in the same shifting region. Therefore, in the present invention, when the printer is performing ink ribbon shifting or resetting, it is not necessary for the print head to travel across the whole region and its track is relatively short, resulting in lower costs for electrics and control.

DETAILED DESCRIPTION OF THE INVENTION

The present invention provides a printer, which comprises a print head, a print head transport mechanism capable of driving the print head to move reciprocally, a carriage connecting the print head and the print head transport mechanism, and a ribbon cassette mounting mechanism provided with a ribbon cassette for a multi color ink ribbon and capable of driving the ribbon cassette to swing, a movement region of the print head consists of one printing region and one shifting region, the printer further comprises a ribbon cassette supporting mechanism, a ribbon cassette shifting mechanism, and a resetting mechanism, wherein:

the ribbon cassette supporting mechanism is located in the shifting region at an end of the trajectories of the print head for correspondingly supporting the ribbon cassette mounting mechanism to different levels to perform ink ribbon shifting while the ribbon cassette supporting mechanism rotates to different angles;

the ribbon cassette shifting mechanism is fixed on the carriage and is used, in the shifting region, to lift the ribbon cassette mounting mechanism up to a position disengaged from the ribbon cassette supporting mechanism and move the ribbon cassette supporting mechanism to rotate to different angles; or to lift the ribbon cassette mounting mechanism up to a position disengaged from the ribbon cassette supporting mechanism and is no longer contacted with the ribbon cassette supporting mechanism;

the resetting mechanism is fixed on the ribbon cassette supporting mechanism for resetting the ribbon cassette supporting mechanism when the ribbon cassette supporting mechanism is no longer subjected to the acting force from the ribbon cassette mounting mechanism and the ribbon cassette shifting mechanism.

Here, the ribbon cassette mounting mechanism comprises a ribbon cassette supporting plate for supporting the ribbon cassette, a supporting plate collision surface is provided on the ribbon cassette supporting plate;

the ribbon cassette shifting mechanism comprises a cam, on which a first collision surface opposite to the said collision surface of the supporting plate is provided, upon contact of the above two collision surfaces, the ribbon cassette supporting plate is lifted to a position disengaged from the ribbon cassette supporting mechanism as the cam moves forward.

Preferably, the resetting mechanism includes a resetting elastic element for resetting the ribbon cassette supporting mechanism to original position.

Next, embodiments of the present invention will be described in further detail in conjunction with the drawings.

Figure 1:
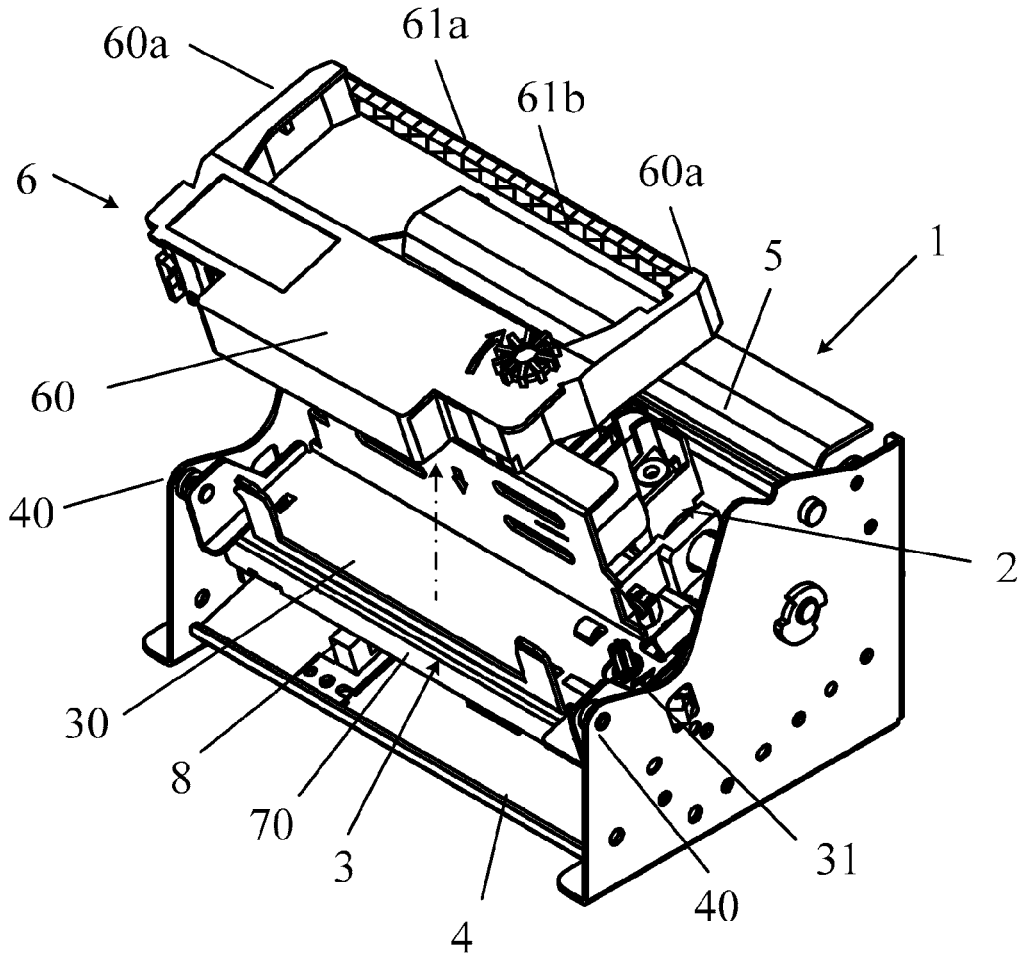
FIG. 1 is a perspective view of appearance of a printer of a preferred embodiment of the present invention.

Referring to FIG. 1, it is a perspective view of appearance of a printer of a preferred embodiment of the present invention. The printer includes a paper-feeding mechanism 1, a printing mechanism 2, a ribbon cassette mounting mechanism 3, a frame 4, a printing platen 5, an ink ribbon 6, an ink ribbon shifting mechanism 7, and a position sensor 8. The printing platen 5 is disposed between left and right side walls at the rear surface side of the frame 4, the paper-feeding mechanism 1 is disposed at the rear surface side of the printing platen 5, and the ribbon cassette mounting mechanism 3 is disposed at the front surface side of the printing platen 5. The printing mechanism 2 is disposed at the front surface side of the printing platen 5 and located between the paper-feeding mechanism 1 and the ribbon cassette mounting mechanism 3.

The paper-feeding portion 1 is provided with a paper-feeding roller (which is not indicated in the drawings) driven by a paper-feeding motor (which is not indicated in the drawings) fixed on the frame 4 for driving printing medium, such as paper, to be fed from the rear surface side to the front surface side of the printing platen 5 and to be moved upward along the printing platen 5.

Figure 2:
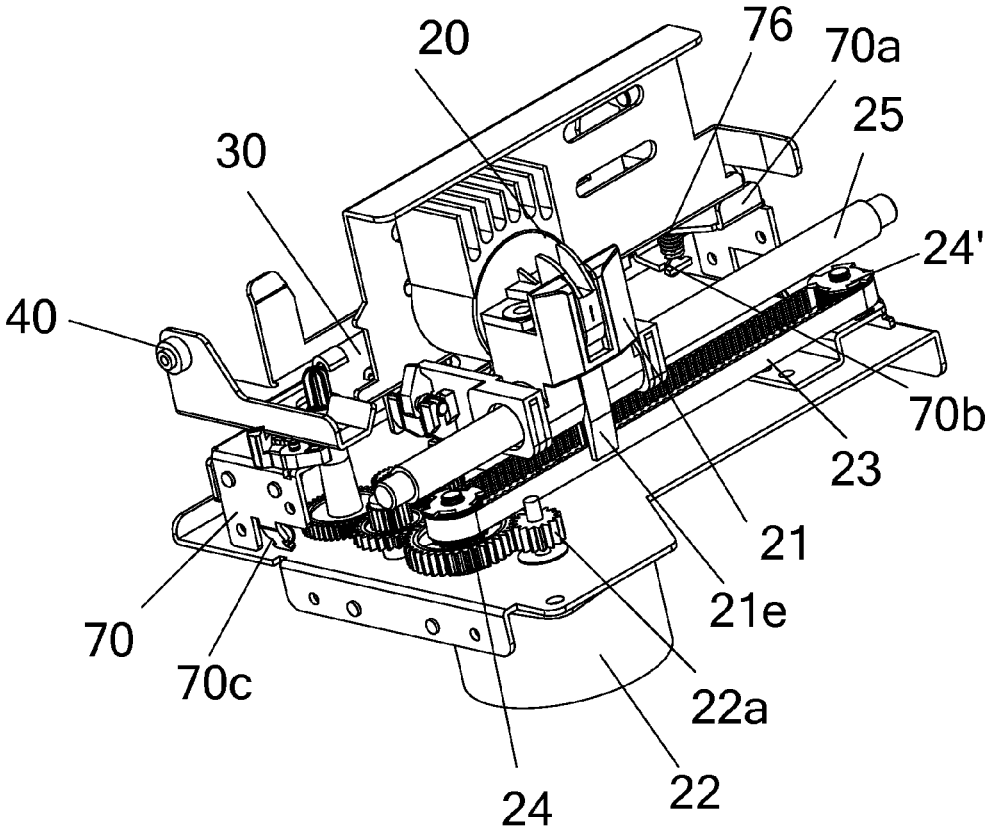
FIG. 2 is a perspective view of a printing mechanism and a ribbon cassette supporting mechanism of the printer in FIG. 1.

As shown in FIG. 2, it is a perspective view of the printing mechanism and the ribbon cassette supporting mechanism of the present invention. Here, the printing mechanism 2 consists of a print head 20, a carriage 21, a guiding shaft 25, and a print head transport mechanism. The print head transport mechanism includes a print head driving motor 22, a print head driving motor gear 22*a*, a toothed belt 23, a toothed belt driving pulley 24 and a toothed belt driven pulley 24' (hereinafter referred to as toothed belt pulleys 24, 24'). Here, the print head 20 is a needle print head that hits ink ribbon through a print needle and thus presses ink of the ink ribbon onto the print medium to form image or text. The print head driving motor gear 22*a* of the print head transport mechanism is fixed at an end of the print head driving motor 22 and rotates with the print head driving motor 22, meanwhile, the print head driving motor gear 22*a* engages with the toothed belt pulley 24, and the toothed belt pulleys 24, 24' engage with the toothed belt 23. The print head 20 is installed on the carriage 21 that engages with the toothed belt 23 through a claw 21*e*. Therefore, the rotation of the print head driving motor 22 is transmitted to the carriage 21 via the motor gear 22*a*, the toothed belt pulley 24, 24' and the toothed belt 23. Thus, the carriage 21 drives the print head 20 to move horizontally and reciprocally. In this way, the print head transport mechanism converts negative and positive rotations of the print head driving motor 22 into reciprocate movement of the print head 20. The guiding shaft 25 passes through the carriage 21, with its both ends being supported on left and right side walls of the frame 4, and is parallel to the printing platen 5 such that the print head is parallel to the printing platen 5 with a certain gap maintained therebetween.

Figure 3:
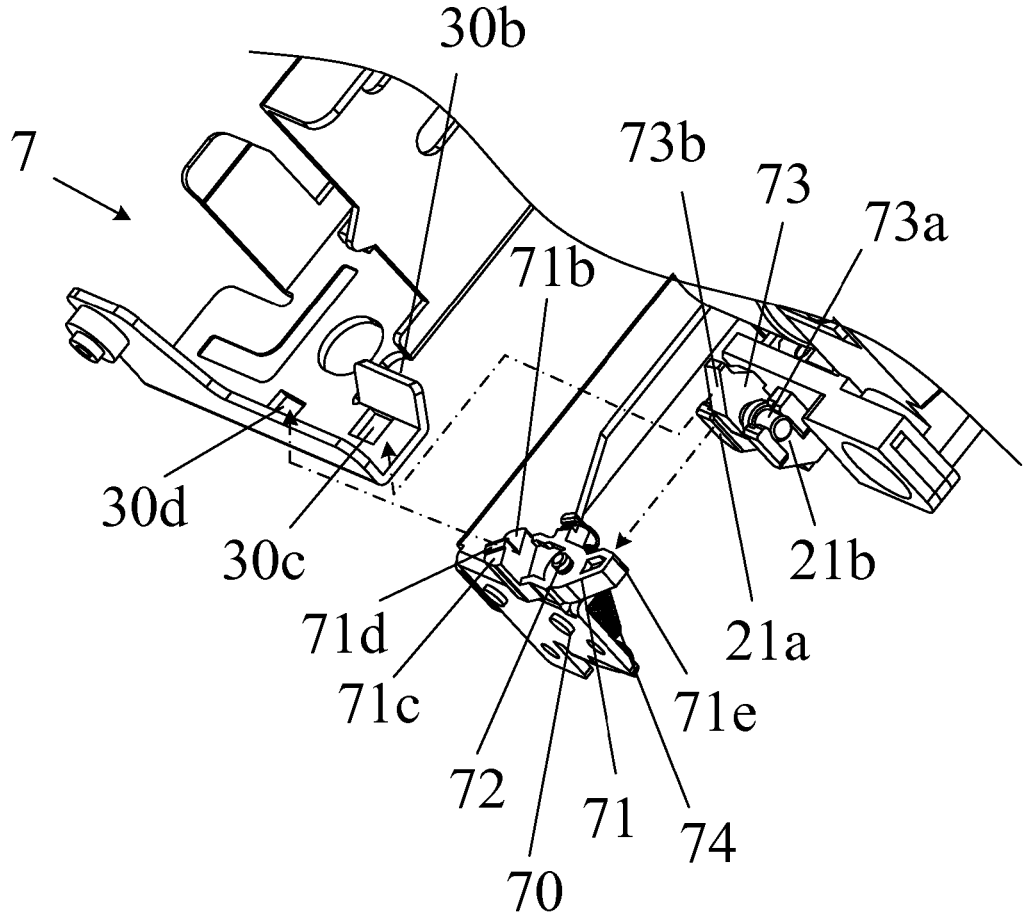
FIG. 3 is a perspective view of an ink ribbon shifting mechanism of the printer in FIG. 1.

Returning back to FIG. 1, the ribbon cassette supporting plate 30 is disposed on the ribbon cassette mounting mechanism 3 and is supported on left and right side walls of the frame 4 through a shaft 40, at the same time, the ribbon cassette supporting plate 30 can swing freely with respect to the frame 4 with the shaft 40 as a center. As shown in FIG. 3, the ribbon cassette supporting plate 30 is further provided with a collision surface 30*b* of the ribbon cassette supporting plate, a shift opening 30*c* and a slot 30*d*, which jointly fit with the ink ribbon shifting mechanism to carry out the lifting/lowering of a ribbon cassette.

As shown in FIG. 1, the ink ribbon 6 consists of a ribbon cassette 60 and a ribbon 61. The ribbon cassette 61 is installed on the ribbon cassette supporting plate 30 and swings along with the ribbon cassette supporting plate 30. A first arm portion 60*a* and a second arm portion 60*b* of the ribbon cassette 60 are formed at the edges on both sides of the ribbon cassette and extend forward. A ribbon 61 led from the end of the first arm portion 60*a* passes through the gap between the print head 20 and the printing platen 5, enters into the second arm portion 60*b*, and then winds circularly inside the ribbon cassette. A ribbon winding gear (not shown) is driven by an ink ribbon driving shaft 31 so as to rotate and implement continuous feeding of the ribbon. In a width direction of the ribbon 61 (the up-down direction in FIG. 1), a plurality of tracks 61*a*, 61*b* are formed side by side, for example, in parallel with each other, a black track 61*a* is formed at a upper side of the ribbon 61, while a red track 61*b* is formed at a bottom side of the ribbon 61. Furthermore, through swinging the ribbon cassette 60, any color of the tracks 61*a*, 61*b* can be arranged at an opposite position to the print head 20. Black or red color printing may thereby be selectively performed.

In the present embodiment, the position of the ribbon cassette supporting plate 30 when the track 61*a* (i.e., the uppermost ribbon) is opposite to the print head 20 is referred to as an original position to be described below, while the position of the ribbon cassette supporting plate 30 when the track 61*b* is opposite to the print head 20 is referred to as a set position to be described below.

In addition, the printer in the present embodiment is further provided with an ink ribbon shifting mechanism 7 for lifting/lowering the ribbon cassette supporting plate 30 and thus implementing the shifting of the tracks 61*a*, 61*b* of the ink ribbon 6. The ink ribbon shifting mechanism 7 includes a ribbon cassette supporting mechanism and a ribbon cassette shifting mechanism, in which the ribbon cassette supporting mechanism includes a bracket 70, a swing block 71, a swing block rotating shaft 72 and a swing block tension spring 74, wherein, the swing block 71 swings horizontally through the swing block rotating shaft 72. The ribbon cassette supporting mechanism serves to support the ribbon cassette supporting plate and swings to different angles by driving of the ribbon cassette shifting mechanism, and correspondingly, the cassette fixing mechanism is lifted or lowered to different levels to shift or reset the ink ribbon. The ribbon cassette shifting mechanism includes a cam 73 and a carriage 21 on which the cam 73 is fixed. The cam 73 moves horizontally and reciprocally with the print head and pushes the ribbon cassette supporting mechanism so as to swing the ribbon cassette supporting plate to different levels for ink ribbon shifting. The printer also includes a controller (not indicated in the drawings), for controlling movement of the print head depending on a step number of the print head corresponding to a color to be shifted into. Details of the controlling method please refer to the description of a printing control method below, wherein, the step number of the print head is detected by a position sensor 8. Since the position sensor 8 of a dot matrix printer is a well known technology to a person skilled in the art, description thereof will be omitted here for concision.

The structural and fitting relationships between the ribbon cassette supporting mechanism and the ribbon cassette shifting mechanism constituting the ink ribbon shifting mechanism will be respectively explained in conjunction with FIGS. 2, 3, 4 and 5.

Referring to the ribbon cassette supporting mechanism shown in FIG. 2, the bracket 70 is located right under the ribbon cassette supporting plate 30, and a supporting edge 70*a* is provided at a side of the bracket 70. When the ribbon cassette supporting plate 30 is located at the original position, a bottom surface of the ribbon cassette supporting plate 30 laps on the supporting edge 70*a* of the bracket 70 for supporting the ribbon cassette supporting plate 30. On the bracket 70 at the same side as the supporting edge 70*a*, a ribbon cassette supporting plate tension spring 76 with one end hanging in a first tension spring groove 70*b* of the bracket and the other end hanging on a groove 30*a* (see FIG. 6) of the ribbon cassette supporting plate 30 is further provided. Through a tension of the ribbon cassette supporting plate tension spring 76, the ribbon cassette supporting plate 30 is subjected to a downward tension all along, so that the ribbon cassette supporting plate 30 always laps stably on the supporting edge 70*a* of the bracket, avoiding print color blending due to the up-down swinging of the ribbon cassette supporting plate 30 possibly caused by vibration of the print head during operation.

Figure 4:
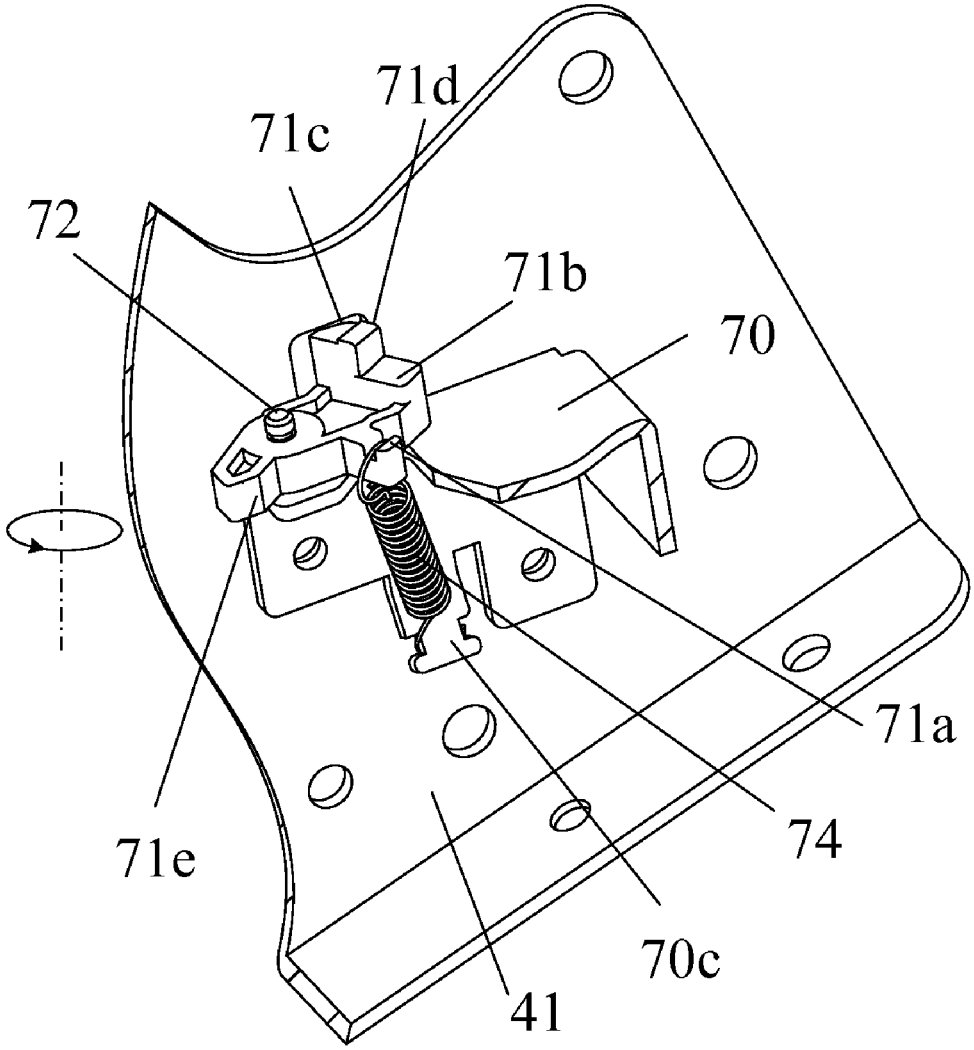
FIG. 4 is a perspective view of a ribbon cassette supporting mechanism in the ink ribbon shifting mechanism of the printer in FIG. 1.

Meanwhile, referring to FIG. 3, which is a perspective view of an ink ribbon shifting mechanism of the printer shown in FIG. 1. On the other side of the bracket 70, a swing block 71, a swing block rotating shaft 72 and a swing block tension spring 74 are further provided. The swing block 71 is installed on the bracket 70 via the swing block rotating shaft 72 and can freely rotate in a horizontal plane around the swing block rotating shaft 72. Referring to FIG. 4, which is a perspective view of a ribbon cassette supporting mechanism in an ink ribbon shifting mechanism of the printer shown in FIG. 1. One end of the swing block tension spring 74 hangs on a swing block groove 71*a* while the other end thereof hangs on a second tension spring groove 70*c* of the bracket 70. Under the tension of the swing block tension spring 74, the swing block 71 tends to rotate counterclockwise in a horizontal plane. However, due to limitation from side walls 41 of the frame 4, the swing block 71 is prevented from continuously rotating counterclockwise by the side walls 41. The swing block tension spring 74 serves to reset the ribbon cassette supporting mechanism to the original position when the ribbon cassette supporting mechanism is not subjected to the action from the ribbon cassette supporting plate 30 and the ribbon cassette shifting mechanism. In the present embodiment, the angle at which the swing block is located currently is referred to as an original angle of the swing block to be described below, i.e., the position shown in FIG. 4. Three steps 71*b*, 71*c*, and 71*d* are further provided on the swing block 71, in which the height of the first step 71*b* is less than or equals to that of the supporting edge 70*a* of the bracket, the height of the second step 71*c* is larger than that of the supporting edge 70*a* of the bracket, and the height of the third step 71*d* is larger than that of the second step 71*c*. When the ribbon cassette supporting plate 30 is located at the original position described above, i.e., when the ribbon cassette supporting plate 30 laps well on the supporting edge 70*a* of the bracket, the swing block 71 here is located at the original position described above, and the first step 71*b* is located right under the ribbon cassette supporting plate 30. When the ribbon cassette supporting plate 30 is located at the set position, i.e., when the ribbon cassette 60 is swung to a set level, the swing block 71 here may rotate to a certain angle and thus rotate the second step 71*c* to be right under the ribbon cassette supporting plate 30. In this way, since the height of the second step 71*c* is larger than that of the supporting edge 70*a* of the bracket, the ribbon cassette supporting plate 30 laps on the second step 71*c*. At this time, the third step 71*d* will just snap into the slot 30*d* of the ribbon cassette supporting plate 30. The angle at which the swing block is located currently is, in the present embodiment, referred to as a second set angle of the swing block 71. At this time, the level at which the ribbon cassette supporting plate swings is just that of the position where the second track 61*b* corresponds to the print head 20, i.e., the set position. Furthermore, a collision surface 71*e* of the swing block is further provided on the swing block 71 for implementing lifting/lowering of the cassette by rotating the swing block 71 under collision driving by the ink ribbon shifting mechanism after the collision surface 71*e* of the swing block contacts with the ink ribbon shifting mechanism.

Figure 5:
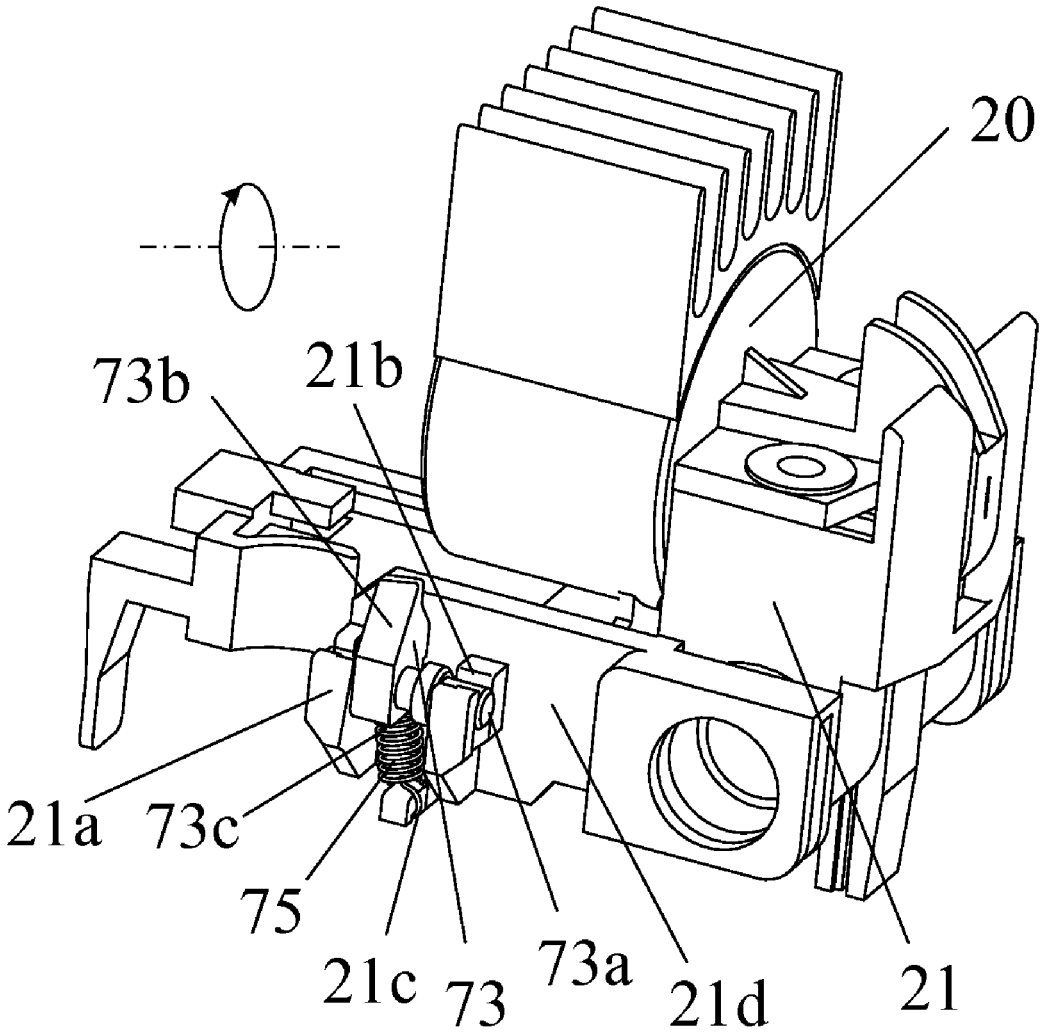
FIG. 5 is a perspective view of a ribbon cassette shifting mechanism in the ink ribbon shifting mechanism of the printer in FIG. 1.

Referring to the ribbon cassette shifting mechanism shown in FIG. 3, at a side of the carriage 21 close to the swing block 71, a cam 73, a rotating shaft 73*a* and a rotating shaft groove 21*b* are provided, wherein, the cam 73 is installed in the rotating shaft groove 21*b* of the carriage through the rotating shaft 73*a* so that the cam 73 can rotate freely in a vertical plane about the rotating shaft 73*a*. At the same time, a first collision surface 73*b* of the cam is also provided on the cam 73 to be opposite in parallel to the collision surface 30*b* of the ribbon cassette supporting plate, for contacting with the collision surface 30*b* of the ribbon cassette supporting plate and thus lifting the ribbon cassette supporting plate 30 to a set level. In addition, a second collision surface 21*a* of the cam is further provided on the cam 73 to be opposite in parallel to the collision surface 71*e* of the swing block, for contacting and colliding with the collision surface 71*e* of the swing block and thus moving the swing block 71 to rotate clockwise at an angle, so as to implement shifting of the swing block 71 between the original angle and a second position. As shown in FIG. 5, it is a perspective view of a ribbon cassette shifting mechanism in an ink ribbon shifting mechanism on the printer of FIG. 1. A cam tension spring 75 is further provided on the ribbon cassette shifting mechanism, with its one end hanging on a tension spring groove 21*c* of the carriage 21 and the other end hanging on the bottom 73*c* of the cam 73, for making the cam 73 always tend to rotate clockwise in a vertical plane under a tension of the cam tension spring 75. However, due to limitations from side walls 21*d* of the carriage 21, the cam 73 is prevented from continuously rotating clockwise by the side walls 21*d* of the carriage 21. Therefore, the cam 73 may be balanced in a position as shown in FIG. 5 without external force.

Next, the process for implementing ink ribbon shifting through cooperation of the ribbon cassette supporting mechanism and the ribbon cassette shifting mechanism will be explained in detail in conjunction with the above described preferred embodiments.

Figure 6:
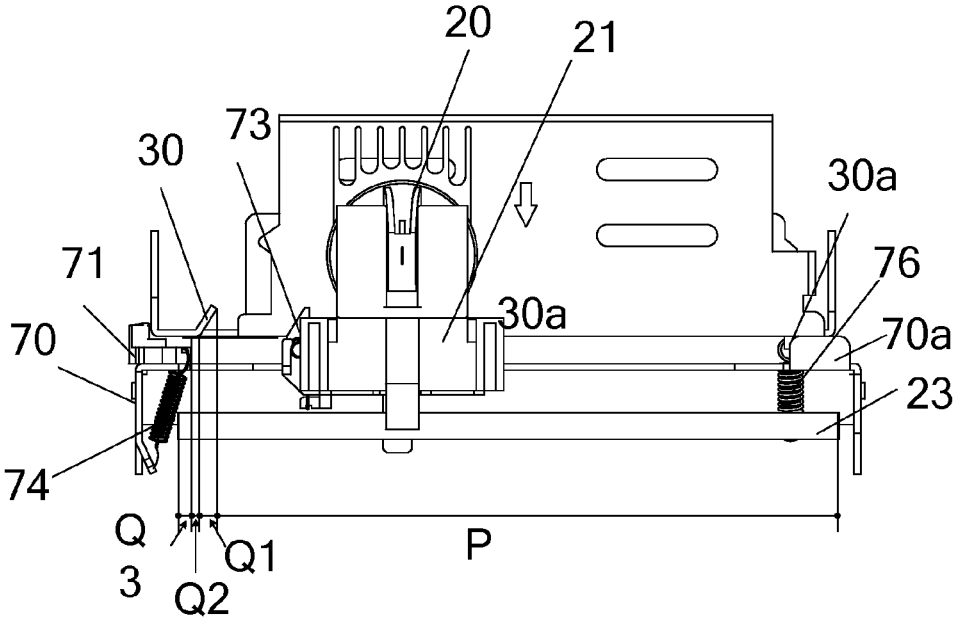
FIG. 6 is a schematic view of the movement region of a carriage in FIG. 1.

Referring to FIG. 6, it is a schematic view of the movement region of a carriage on the printer in FIG. 1. In the present embodiment, the reciprocate movement region of the carriage 21 is divided into a printing region P and a shifting region Q, in which the shifting region Q can be further divided into a first shifting region Q1, a second shifting region Q2 and a third shifting region Q3.

It is a premise for the ink ribbon shifting process to have the ribbon cassette supporting plate 30 located at the original position described above, i.e., the position of the print head 20 corresponds to that of the black track 61*a*. To implement lifting of the ribbon cassette 60, the print head transport mechanism drives the carriage 21 to move from the printing region P to the shifting region Q. At a first step, the carriage 21 moves from the printing region P to the first shifting region Q1. When the carriage 21 moves to an intersection point of the printing region P and the first shifting region Q1, as shown in combination with FIG. 3, the first collision surface 73*b* of the cam next to the carriage 21 is just brought into contact with the collision surface 30*b* of the ribbon cassette supporting plate. And, as the carriage 21 moves in the first shifting region Q1, the collision surface 30*b* of the ribbon cassette supporting plate is pressed by the first collision surface 73*b* of the cam and thus the ribbon cassette supporting plate 30 is lifted up under the driving. As the carriage 21 moves to an intersection point of the first shifting region Q1 and the second shifting region Q2, the first collision surface 73*b* of the cam lifts the ribbon cassette supporting plate 30 to the highest position, the height of which is larger than that of the third step 71*d* of the swing block 71.

In a second step, the carriage 21 moves into the second shifting region Q2 and continues to move forward. In the second shifting region Q2, the ribbon cassette supporting plate 30 is always remained in the highest position under the support of the cam 73. The second collision surface 21*a* of the cam contacts with the collision surface 71*e* of the swing block, and presses the collision surface 71*e* of the swing block under continuous driving of the carriage 21. Then the swing block 71 rotates clockwise against the tension from the swing block tension spring 74 under the driving of the carriage 21. When the carriage 21 moves to an intersection point of the second shifting region Q2 and the third region Q3, the swing block 71 just rotates to the set angle. At this time, the second step 71*c* of the swing block 71 just rotates to be right under the ribbon cassette supporting plate 30.

In a third step, the carriage 21 moves from the second shifting region Q2 into the third shifting region Q3. As the cam 73 snaps into the shifting opening 30*c* of the ribbon cassette supporting plate, the ribbon cassette supporting plate 30 is lowered due to the lack of the support from the first collision surface 73*b* of the cam. At this time, the third step 71*d* of the swing block 71 just snaps into the slot 30*d* of the ribbon cassette supporting plate 30, while the ribbon cassette supporting plate 30 will laps on the second step 71*c* of the swing block 71, that is to say, the swing block 71 is rotated to the second position under the driving of the cam 73. The ribbon cassette supporting plate 30 is disposed on the set position, while the track 61*b* of the ink ribbon is shifted to a position opposite to the print head 20. Meanwhile, since the third step 71*d* of the swing block 71 is snapped into the slot 30*d* of the ribbon cassette supporting plate, the tendency of the swing block 71 to rotate counterclockwise under the tension from the swing block tension spring 74 is restrained by the limitation of the slot 30*d* of the ribbon cassette supporting plate. The swing block 71 can thus be stabled at the second position, that is to say, the ribbon cassette supporting plate 30 can thus also be stabled at the set position.

In a fourth step, as the carriage 21 moves from the third shifting region Q3 to the second shifting region Q2, the cam 73 and the edges of the shifting opening 30*c* of the ribbon cassette supporting plate press with each other. Since the tension from the tension spring 75 of the cam is substantially smaller than the pressing force of the edges of the shifting opening 30*c* of the ribbon cassette supporting plate, the cam 73 rotates counterclockwise and thus disengages from the shifting opening 30*c* of the ribbon cassette supporting plate against the action of the tension spring 75 of the cam. Then, the carriage 21 moves from the third shifting region Q3 back to the second shifting region Q2 and the first shifting region Q1. At this time, since the ribbon cassette supporting plate 30 is still supported by the second step 71*c* of the swing block 71, the ribbon cassette supporting plate 30 remains stable at the set position. The shifting process of the ribbon cassette is then finished, and the carriage 21 moves from the shifting region Q to the printing region P to perform printing task.

Next, the process for implementing ink ribbon resetting through cooperation of the ribbon cassette supporting mechanism and the ribbon cassette shifting mechanism will be explained in detail in conjunction with the above described preferred embodiments.

It is a premise for this operation process to have the ribbon cassette being located at the set position described above, i.e., the red track 61*b* is opposite to the print head 20. To lower the height of the ribbon cassette, the print head transport mechanism drives the carriage 21 to move from the printing region P to the shifting region Q. In a first step, as shown in combination with FIG. 3, the carriage 21 moves from the printing region P to the first shifting region Q1. When the carriage 21 moves in the first shifting region Q1, the first collision surface 73*b* of the cam may contact with the collision surface 30*b* of the ribbon cassette supporting plate. And, as the carriage 21 continues to move forward, the collision surface 30*b* of the ribbon cassette supporting plate is pressed by the first collision surface 73*b* of the cam and thus the ribbon cassette supporting plate 30 is lifted under the driving. As the carriage 21 moves to an intersection point of the first shifting region Q1 and the second shifting region Q2, the first collision surface 73*b* of the cam lifts the ribbon cassette supporting plate 30 to the highest position, the height of which is larger than that of the third step 71*d* of the swing block 71, then the third step 71*d* of the swing block 71 disengages from the slot 30*d* of the ribbon cassette supporting plate. Meanwhile, the second collision surface 21*a* of the cam is just brought into contact with the collision surface 71*e* of the swing block. However, since no actions occur, the swing block 71 rotates counterclockwise under the tension from the tension spring 74 of the swing block until it returns to the original angle. In a second step, the carriage 21 moves from the first shifting region Q1 to the printing region P, and the first collision surface 73*b* of the cam disengages from the collision surface 30*b* of the ribbon cassette supporting plate, such that the ribbon cassette supporting plate 30 is lowered until it laps on the supporting edge 70*a* of the bracket. At this time, the ribbon cassette supporting plate 30 is reset to the original position, and the corresponding position of the ribbon 61 of the ink ribbon with the print head 20 is also reset from the position of the track 61*b* to the position of the track 61*a*. The operation for resetting the ribbon cassette is then finished. After that, the carriage 21 can continue to move from the shift region Q to the printing region P to perform printing task.

Figure 7:
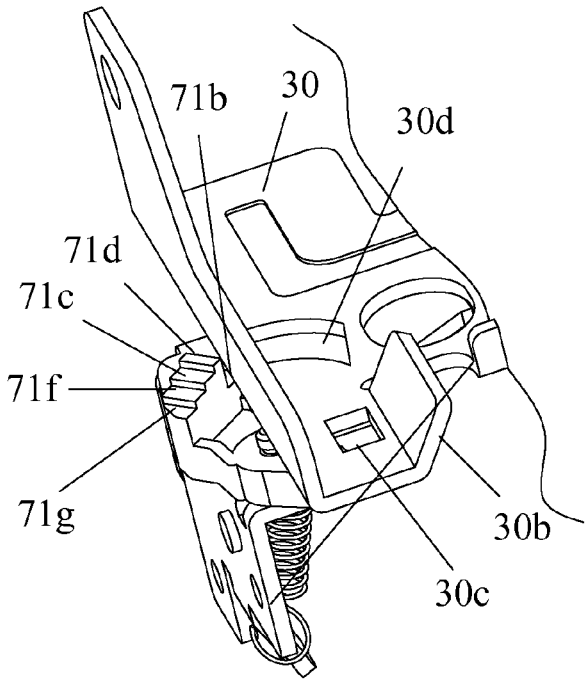
FIG. 7 is a perspective view of the first embodiment of a ribbon cassette supporting mechanism for multi color shifting of the present invention.

In addition, the printer provided in the present invention may also be applicable to multiple color ink ribbon shifting, i.e., the shifting of more than two ribbons. As shown in FIG. 7, it is a perspective view of the first embodiment of a ribbon cassette supporting mechanism for multiple color ink ribbon shifting of the present invention. As for an ink ribbon of four colors, e.g., black, purple, green and red, respectively, arranged from top to bottom in its width direction, the number of steps of the ribbon cassette supporting mechanism is five correspondingly, as shown in FIG. 7. The steps corresponding to the colors are in turn a first step 71*b*, a second step 71*g*, a third step 71*f*, a fourth step 71*c* and a highest fifth step 71*d*, respectively, for defining the positions. Here, in a case where the first step 71*b* is a flat surface, when the ink ribbon is located at the original position, i.e., the black ribbon corresponds to the print head, at this time the first step 71*b* is located under the ribbon cassette supporting plate 30. In the shifting region, the cam lifts the ribbon cassette supporting plate 30 up to a position higher than the ribbon cassette supporting mechanism and maintains it at the highest position by a distance under the driving resulting from the contact of the cam and the collision surface 30*b* of the ribbon cassette supporting plate, such that the highest fifth step 71*d* of the swing block 71 rotates into the slot 30*d*, while the cam also falls into the shifting opening 30*c* quickly. After that, as the cam continues to move forward, it pushes the swing block 71 to rotate to a desired set angle. At this time, the ribbon cassette supporting plate 30 is supported at a desired set level by a corresponding step, implementing the shifting of the ink ribbon.

Figure 8:
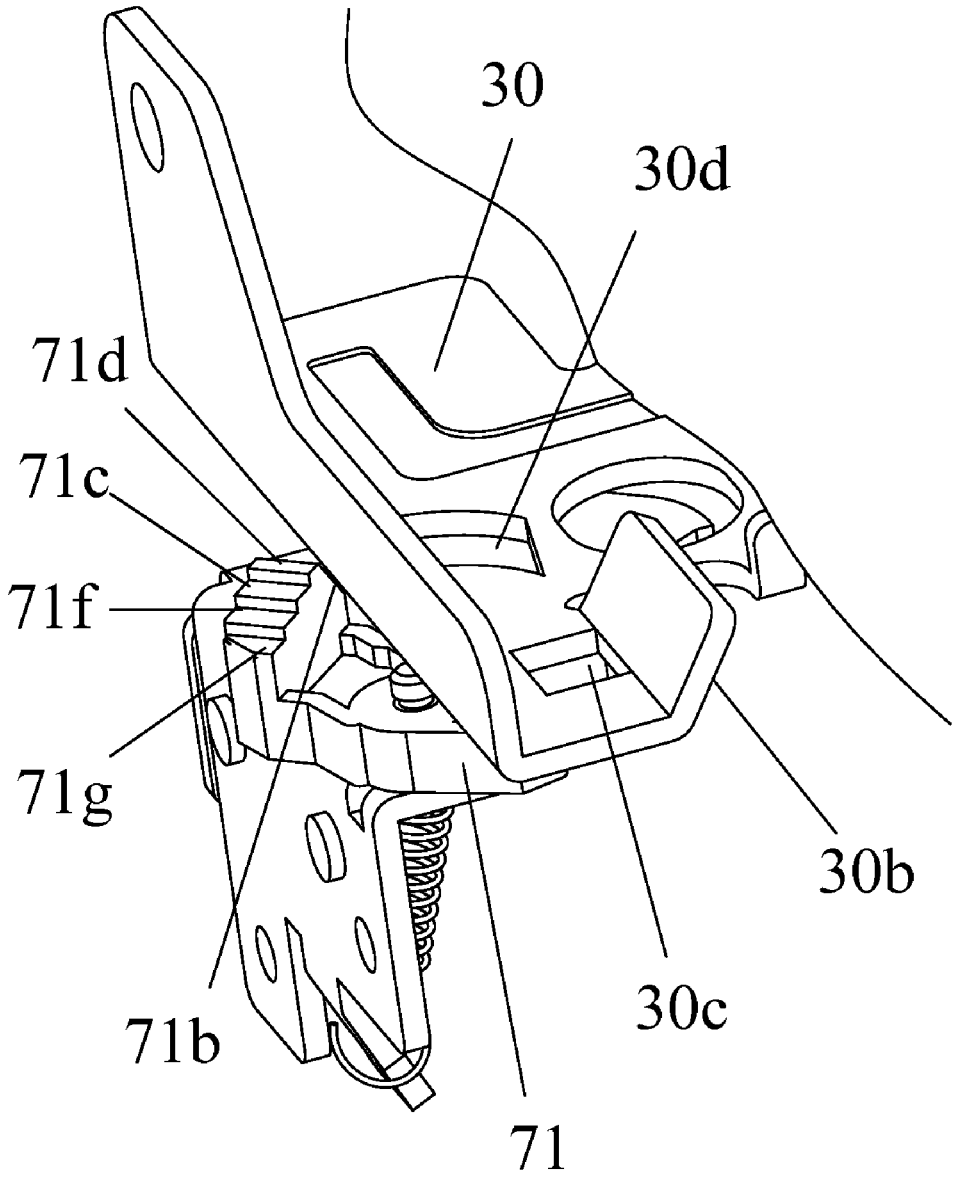
FIG. 8 is a perspective view of the second embodiment of a ribbon cassette supporting mechanism for multi color ink ribbon shifting of the present invention.

Here, the first step 71*b* may also be a slope, as shown in FIG. 8. In this case, when the ink ribbon is located at the original position, i.e., when the black ribbon corresponds to the print head, the first step 71*b* does not contact with ribbon cassette supporting plate 30. After lifting the ribbon cassette supporting plate up to the highest position, the cam immediately falls into the shifting opening 30*c*. At this time, the fifth step 71*d* of the swing block 71 supports the ribbon cassette supporting plate 30 with its slope. And, as the cam continues to move forward, the fifth step moves into the slot 30*d*. After that, according to the requirement of a user, the cam pushes the swing block 71 to rotate to a desired set angel, while the ribbon cassette supporting plate 30 is supported at a desired set level by a corresponding step, implementing the shifting of the ink ribbon.

As for the resetting of a multi color ink ribbon, its process is similar to that for implementing ink ribbon resetting through cooperation of the ribbon cassette supporting mechanism and the ribbon cassette shifting mechanism in the preferred embodiment of two color ink ribbon described above, therefore, description thereof will be omitted here for concision.

Based on the above described conception, the present invention also provides a printing control method capable of driving the print head to move reciprocally in both the printing region and the shifting region through rotating of a driving motor, which includes:

the ribbon cassette shifting mechanism moves into the shifting region, contacts the cassette mounting mechanism, and lifts the fixing mechanism up to a position disengaged from the ribbon cassette supporting mechanism, after that, the ribbon cassette shifting mechanism continues to move forward, contacts the ribbon cassette supporting mechanism, and pushes the supporting mechanism to different angles, such that the ribbon cassette supporting mechanism supports the cassette mounting mechanism to different levels, to perform the shifting; or the ribbon cassette shifting mechanism no longer applies force to the ribbon cassette supporting mechanism, such that the ribbon cassette supporting mechanism is reset by the resetting mechanism.

Here, when the ribbon cassette supporting mechanism is located at the original angle, correspondingly, the ribbon cassette supporting plate is located at the original position, after lifting the ribbon cassette supporting plate up to a position disengaged from the ribbon cassette supporting mechanism, the ribbon cassette shifting mechanism continues to move forward and thus pushes the ribbon cassette supporting mechanism to rotate to a set angle, so as to implement the shifting of the ink ribbon;

When the ribbon cassette supporting mechanism is located at a set angle, correspondingly, the ribbon cassette supporting plate is located at a set position, the ribbon cassette shifting mechanism lifts the ribbon cassette supporting plate up to a position disengaged from the ribbon cassette supporting mechanism and then returns. The ribbon cassette supporting mechanism is reset to the original position by an elastic element, implementing the resetting of the ink ribbon.

Figure 9:
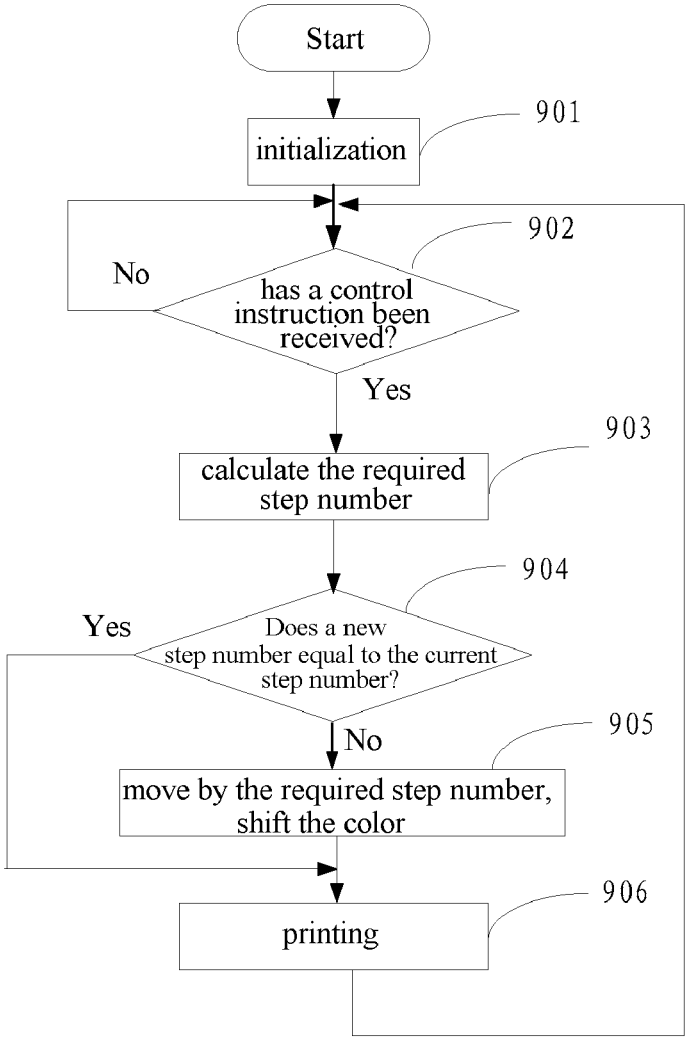
FIG. 9 is a flowchart of the first preferred embodiment of the printing control method of the present invention

Referring to FIG. 9, it is a flowchart of the first embodiment of the printing control method of the present invention. The shifting method specifically includes the following steps:

Step 901: the printer is initialized.

Step 902: it is determined whether a control instruction has been received. If yes, step 903 is performed; otherwise, the step 902 is repeated. Here, the control instruction is preferably to be data information triggering the printer to print new task. After receiving such control instruction, the printer performs the following shifting or printing.

Step 903 to step 904: step number of the moving of the print head corresponding to a new color is calculated, and it is determined whether the step number equals to the step number of the print head corresponding to a current color? If not, the step 905 is performed; otherwise, the step 906 is performed.

Figure 10:
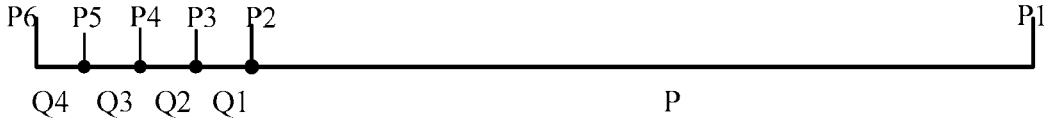
FIG. 10 is a schematic view of the movement region of a multi color carriage of the present invention.

Step 905: the print head moves into the shifting region to shift the ink ribbon. As shown in Table 1, to facilitate description, the shifting region Q is divided into four regions according to the corresponding color of the ink ribbon, i.e., a lifting region Q1, a red shifting region Q2, a purple shifting region Q3, and a green shifting region Q4 from the nearest to the farthest from the printing region P. The intersection point of the printing region P and the shifting region Q is set as P2, the intersection point of the lifting region Q1 and the red shifting region Q2 is set as P3, the intersection point of the red shifting region Q2 and the purple shifting region Q3 is set as P4, the intersection point of the purple shifting region Q3 and the green shifting region Q4 is set as P5, and the endpoint of the green shifting region Q4 is set as P6. Referring to FIG. 10, the cam moves from the printing region P to the shifting region Q, when the cam moves to the point P2, the cam and the collision surface of the ribbon cassette supporting plate 30 contact;

when the cam moves into the lifting region Q1, it lifts the ribbon cassette supporting plate 30; and when the cam moves to the position P3, the ribbon cassette supporting plate 30 is lifted to the highest position while the black color is opposite to the print head. After that, as the cam continues to move forward to different shifting regions and arrives at the end-point of this region, the ribbon cassette supporting plate 30 can correspondingly be lifted to the respective position and the ink ribbon is then shifted to a color corresponding to this region. The ink ribbon shifting process of the printer is similar to that as described in FIG. 6, and description thereof will be omitted here for concision.

TABLE 1

| Color | Step number | Position |
|---|---|---|
| Black | 10 | P3 |
| Red | 11 | P4 |
| Purple | 12 | P5 |
| Green | 13 | P6 |

Step 906: the print head returns to the printing region P for printing. The specific printing method belongs to prior art, and description thereof will be omitted here for concision.

The embodiments of the present invention described above do not form limitations to the scope of protection for the present invention. All modifications, equivalent alternatives, and improvements within the spirits and the principles of the present invention should be included in the scope of protection for the present invention.

The invention claimed is:

1. A printer, comprising a print head, a print head transport mechanism capable of driving the print head to move reciprocally, a carriage connecting the print head and the print head transport mechanism, and a ribbon cassette mounting mechanism provided with a ribbon cassette for a multi color ink ribbon and capable of driving the ribbon cassette to swing, wherein, a movement region of the print head consists of one printing region and one shifting region, the printer further comprises a ribbon cassette supporting mechanism, a ribbon cassette shifting mechanism, and a resetting mechanism, wherein, the ribbon cassette supporting mechanism is located in the shifting region for correspondingly supporting the ribbon cassette mounting mechanism at different levels while the ribbon cassette supporting mechanism rotates to different angles, so as to shift color of the ink ribbon;

the ribbon cassette shifting mechanism is fixed on the carriage and is used, in the shifting region, to lift the ribbon cassette mounting mechanism up to a position disengaged from the ribbon cassette supporting mechanism and to move the ribbon cassette supporting mechanism to rotate to different angles; and the resetting mechanism is fixed on the ribbon cassette supporting mechanism for resetting the ribbon cassette supporting mechanism when the ribbon cassette supporting mechanism is no longer contacted with the ribbon cassette mounting mechanism and the ribbon cassette shifting mechanism.

2. The printer according to claim 1, wherein the ribbon cassette mounting mechanism comprises a ribbon cassette supporting plate for supporting the ribbon cassette, a supporting plate collision surface is provided on the ribbon cassette supporting plate; and the ribbon cassette shifting mechanism comprises a cam, on which a first collision surface opposite to the said collision surface of the supporting plate is provided, upon contact of the above two collision surfaces, the ribbon cassette supporting plate is lifted to a position disengaged from the ribbon cassette supporting mechanism as the cam moves forward.

3. The printer according to claim 2, wherein the ribbon cassette supporting plate is further provided with a shifting opening, after the cam holds the ribbon cassette supporting plate to the position disengaged from the ribbon cassette supporting mechanism, the cam continues to move forward and then enters into the shifting opening where it implements the shifting by continually moving forward and thus pushing the ribbon cassette supporting mechanism to rotate.

4. The printer according to claim 3, wherein the ribbon cassette supporting plate is further provided with a slot, such that the ribbon cassette supporting mechanism is snapped into the slot after rotating to a set angle, so as to restrain the ribbon cassette supporting mechanism at the set angle.

5. The printer according to claim 4, wherein the ribbon cassette supporting mechanism comprises a swing block and a swing block rotating shaft, with the swing block being swingable horizontally around the swing block rotating shaft; and the swing block is further provided with steps for cooperating with the slot, enabling a corresponding step to snap into the slot when the swing block rotates to a set angle and the ribbon cassette supporting plate is supported at a corresponding position where the required color is positioned for printing by the print head.

6. The printer according to claim 1, wherein the resetting mechanism comprises a resetting elastic element for resetting the ribbon cassette supporting mechanism to an original position.

7. The printer according to claim 2, wherein the ribbon cassette shifting mechanism further comprises:

a rotating shaft and a carriage rotating shaft groove, the cam is installed in the carriage rotating shaft groove through the rotating shaft, so that the cam can rotate freely in a vertical plane along with the rotating shaft; and a cam elastic element fixed between the cam and the carriage, the cam is reset to an original position by the cam elastic element.

8. The printer according to claim 2, wherein the ribbon cassette supporting mechanism further comprises a bracket supported under the ribbon cassette mounting mechanism, a bracket supporting edge is further provided at an end of the bracket to lap with the bottom surface of the ribbon cassette supporting plate when the ribbon cassette is located at an original position.

9. The printer according to claim 8, further comprising:

a ribbon cassette supporting plate elastic element fixed between the bracket and the ribbon cassette supporting plate.

10. A printing control method comprising the steps of shifting a print color by moving a print head of a printer in a movement region consisting of one printing region and one shifting region, driving a ribbon cassette shifting mechanism with the print head to move from the printing region to the shifting region, so as to contact a ribbon cassette mounting mechanism;

lifting up the ribbon cassette mounting mechanism to a position disengaged from a ribbon cassette supporting mechanism of the printer;

after the ribbon cassette mounting mechanism is lifted up to a position disengaged from a ribbon cassette supporting mechanism of the printer, selectively performing the following steps:

continuing to move the ribbon cassette shifting mechanism to contact the ribbon cassette supporting mechanism and push the ribbon cassette supporting mechanism to rotate to different angles, so as to correspondingly make the ribbon cassette supporting mechanism support the ribbon cassette mounting mechanism at different levels, or moving the ribbon cassette shifting mechanism so that it is no longer contacted with the ribbon cassette supporting mechanism, so as to allow the ribbon cassette supporting mechanism to reset to an original angle.

11. The printing control method according to claim 10, wherein, when the ribbon cassette supporting mechanism rotates to the original angle, correspondingly, the ribbon cassette mounting mechanism is supported at an original position;

the step of moving the ribbon cassette shifting mechanism to push the ribbon cassette supporting mechanism to rotate to different angles specifically is:

continuing to move the print head forward by a set step number, and driving the ribbon cassette shifting mechanism to push the ribbon cassette supporting mechanism to rotate to a set angle; and the step of moving the ribbon cassette shifting mechanism so that it is no longer contacted with the ribbon cassette supporting mechanism specifically is:

driving the ribbon cassette shifting mechanism with the print head to move from the shifting region to the printing region.

12. The printing control method according to claim 10, further comprising a step of:

determining whether a step number of the print head corresponding to a new color equals to a step number of the print head corresponding to a current color, if yes, performing printing directly; otherwise, performing a shifting action.

13. The printing control method according to claim 11, further comprising a step of:

determining whether a step number of the print head corresponding to a new color equals to a step number of the print head corresponding to a current color, if yes, performing printing directly; otherwise, performing a shifting action.

* * * * *